United States Patent [19]

Schiel et al.

[11] Patent Number: 4,584,059

[45] Date of Patent: Apr. 22, 1986

[54] BELT PRESS UNIT, PREFERABLY AS WET PRESS OF A PAPER MACHINE

[75] Inventors: Christian Schiel, Heidenheim; Karl Steiner, Herbrechtingen; Hans Flämig, Heidenheim, all of Fed. Rep. of Germany

[73] Assignee: J. M. Voith GmbH, Fed. Rep. of Germany

[21] Appl. No.: 753,341

[22] Filed: Jul. 10, 1985

Related U.S. Application Data

[63] Continuation of Ser. No. 592,629, Mar. 23, 1984, abandoned.

[30] Foreign Application Priority Data

Apr. 2, 1983 [DE] Fed. Rep. of Germany ..... 3311998

[51] Int. Cl.[4] ..... D21F 3/02; D21F 3/08

[52] U.S. Cl. ..... 162/361; 29/113 AD; 29/116 AD; 100/118; 100/153; 162/205; 162/358

[58] Field of Search ..... 162/358, 360.1, 361, 162/205; 100/118, 153, 154, 93 RP; 29/113 AD, 116 AD

[56] References Cited

U.S. PATENT DOCUMENTS

| | | | |
|---|---|---|---|
| 3,269,893 | 8/1966 | Rojecki | 162/358 |
| 3,586,602 | 6/1971 | Schmidt | 162/361 |
| 4,272,317 | 6/1981 | Roerig | 162/358 |
| 4,287,021 | 9/1981 | Justus et al. | 162/358 |
| 4,518,460 | 5/1985 | Hauser et al. | 162/361 |

FOREIGN PATENT DOCUMENTS

82/02567 1/1982 PCT Int'l Appl. .

*Primary Examiner*—S. Leon Bashore
*Assistant Examiner*—K. M. Hastings
*Attorney, Agent, or Firm*—Ostrolenk, Faber, Gerb & Soffen

[57] ABSTRACT

The belt press unit of a paper machine includes an elastic tubular press belt which passes around the circumference of and is spaced from the surface of a hollow, annular supporting body. A press shoe in the supporting body presses outwardly and urges the press belt against an opposing surface on a mating roller for defining a press nip. Circumferentially outside of the press zone, each of a plurality of circumferentially spaced guide ledges extends across the direction of travel of the belt. A torsionally rigid beam extends through and is attached at two axially spaced locations along the hollow of the annular supporting body. At least one of the guide ledges is supported to the beam, whereby radial deflection of the supporting body does not result in radial deflection of the beam and thus does not cause radial shifting of the guide ledge. The beam is axially displaceable with respect to the supporting body. The ledge is supported on stay bolts which are guided by wedge-shaped supporting surfaces on the beam. These surfaces shift the stay bolts and thereby shift the ledges radially as the beam shifts axially with respect to the supporting body.

20 Claims, 6 Drawing Figures

Fig.2
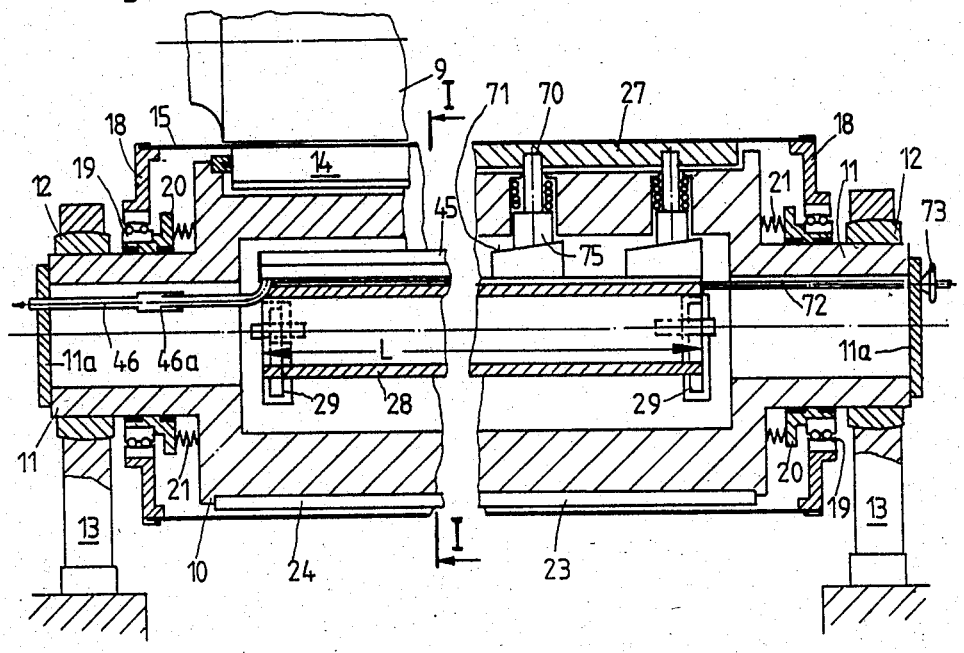
Fig. 2a
Fig. 5
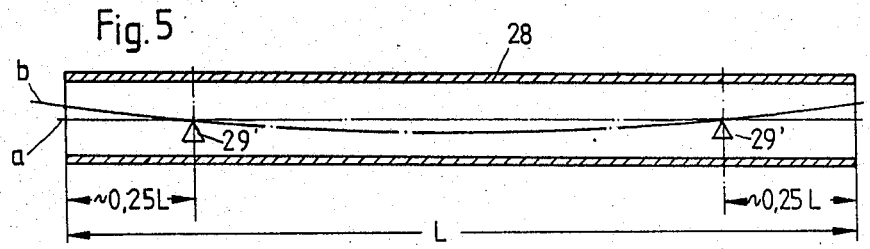

BELT PRESS UNIT, PREFERABLY AS WET PRESS OF A PAPER MACHINE

This is a continuation of U.S. patent application Ser. No. 592,629, filed on Mar. 23, 1984, now abandoned, in the name of Christian Schiel, et al., for Belt Press Unit, Preferably as Wet Press of a Paper Machine.

BACKGROUND OF THE INVENTION

1. Field of the Invention

The invention relates to a belt press unit, which preferably serves as a wet press of a paper machine. More particularly, the invention relates to the support by a support beam of the press belt of the belt press unit, particularly with a press belt which may be inflated.

A belt press unit in a paper machine is a pressing device which has a so-called "extended press nip." This means that the press nip is formed between a rotating surface, preferably the cylindrical surface of an ordinary press roll (or "back roll"), on the one hand, and an elastic tubular press belt, on the other hand. The press belt is adapted to be pressed against the back roll by means of a pressing device (for instance, a press shoe). In this way, the press nip that is produced is relatively long in the circumferential direction so that pressure is exerted on the web of paper (which passes through the press nip together with a felt belt) over a greater length of the press belt than in a traditional roll press cnsisting of two opposing rolls.

2. Description of the Prior Art

Various prior art references disclose extended nip presses.

German Patent Application DE-OS No. 31 26 492 discloses a press unit with a box-shaped supporting body around which the tubular press belt travels. Outside the press zone, the belt travels at a large distance away from the supporting body. The ends of the press belt are fastened to tensioning disks which can rotate on the journal pins of the supporting body. One disadvantage of this construction is that no guide elements for the press belt are present outside the press zone, as seen in cross-section. There is a danger that the press belt will not more smoothly, particlarly at high operating speeds.

German Patent Applicaton DE-OS No. 31 02 526 discloses belt press units having a substantially roll-shaped supporting member. In accordance with FIG. 1, the press belt rotates predominantly at a slight distance from the outer surface of the supporting body. According to FIGS. 4 and 5, the press belt slides over the supporting body. In this case, high frictional heat is produced. A large number of lubricating chambers are distributed over the circumference of the outer clindrical surface of the supporting body for the feeding of a lubricating liquid. Outside the press zone, a slide shoe is provided in the supporting body. This shoe cooperates with a drive roll and can be used also for retightening the press belt.

U.S. Pat. No. 4,287,021 shows a press belt which passes predominantly around the supporting body at a slight distance from it. The supporting body has an "apple"-shaped cross-section which is difficult to produce. Before entrance into the press zone, the press belt is guided by an outer curved guide surface in order to avoid fluttering of the press belt.

German Patent Application DE-OS No. 31 26 492, noted above, and U.S. Pat. No. 3,269,893 and German Patent Application DE-OS No. 19 23 784 show that the tubular press belt can form a closed inner space together with two side tensioning disks. This inner space can be inflated by compressed air, whereby one speaks of an "inflatable tube roll". Such a closed inner space is also provided in above noted DE-OS No. 31 02 526, but not in U.S. Pat. No. 4,287,021 since in the latter case, the cross-section of the supporting body differs too much from a circular shape. In the latter case, the inner space surrounded by the press belt is open toward the outside on both ends so that there is an danger of dirtying the machine by emerging lubricating oil.

The construction in German Patent Application No. 19 23 784, FIGS. 11 and 12, guides the press belt in the region outside the press zone by guide rolls which are mounted on the supporting body. One disadvantage of this construction is that it can be used, at most, for very narrow width paper machines because the guide rolls, which must be arranged within the tubular press belt, can only be of small diameter and thus are deflected (at least under their own weight).

The invention proceeds from the known construction including a tubular, laterally closed press belt and in which, as seen in cross-section, the press belt is guided outside the press zone by a guide device. This design has been generally known for more than twelve years. It is also known that substantially higher solid cntents can be obtained in the web of paper to be drained when using a wet press with an extended press nip at the end of the press end than when using traditional roll presses and that a considerable saving of energy can be obtained upon the subsequent thermal drying of the web of paper. Nevertheless, no one has, to the best of the applicant's knowledge, employed a belt press unit according to any of the above prior art references in the press end of an industrially employed paper machine. Only in the type of construction according to German Patent Application DE-OS No. 30 40 891, equivalent to U.S. Pat. No. 4,272,317 are wet presses with extended press nip presently used. In that case, the press belt travels over several guide rolls. Some of those rolls are mounted in swing levers for the tensioning of the press belt. The structural expense of this is greater than when using a tubular press belt. Furthermore, there is the danger of dirtying from lubricant which emerges laterally from the press-belt loop.

The difficulities which have stood in the way of the use of a belt press unit with a tubular press belt are caused primarily by the numerous requirements for a suitable design.

1. The press belt must not twist or form wrinkles. In other words, the points of an imaginary line extending transverse to the direction of rotation of the press belt must all move with exactly the same speed.

2. The amount of drive energy required for rotation of the press belt should be as small as possible. This also applies to the start-up of the belt press unit, i.e., the starting torque should be as small as possible. Usually, a separate drive is not provided for the press belt. Instead, it is carried along by the felt belt on which the paper web is dewatered.

3. The life of the press belt and of the press shoe should be as long as possible. For this, the heat produced must be effectively removed.

4. The above requirements apply also for the dimensions (work width up to 10 m) and travel speeds (on the order of 1000 m/min.) which are customary in modern paper machines.

SUMMARY OF THE INVENTION

The object of the invention is to provide an improved design for a belt press unit with a tubular press belt which assures the quietest possible travel of the press belt, even with high speeds of rotation, and wherein the requirements indicated above can be satisfied to the greatest extent possible.

Accordng to the invention, the belt press unit for a paper machine includes an annular supportng body about which the endless belt travels in a path of travel in one direction. A press shoe is positioned at the exterior of the supporting body and is urged outwardly against a cooperating opposing surface, such as the surface of a mating or back roll, whereby the press belt, the dewatering felt and the web may all pass through the press nip defined at the press shoe. The press belt is an elastic belt and is flexible to deflect. The axial ends of the press belt may be sealed, whereby the interior of the tubular belt may be inflated. The size and shape of the press belt with respect to the supporting body enables there to be a distance between the press belt and the supporting body in the circumferential region outside the press zone.

There is at least one, and more usually a plurality, of guide ledges supported on the supporting body at locations circumferentially outside the press zone. Each of the guide ledges is shaped and positioned with respect to the supporting body so as to rest against the inner surface of the press belt as the press belt travels around the supporting body during at least certain rotation and inflation conditions of the press belt.

There is a substantially torsionally rigid beam that extends along the support body and that is spaced from the support body but that is supported to the support body at two axially spaced apart locations along that beam. The beam extends in a direction across the path of travel of the press belt around the supporting body. Preferably, the supporting body is a hollow annulus and the beam extends through that annulus. At least one guide ledge is supported on the beam and the guide ledge also extends across the path of travel of the press belt. The guide ledge is positioned and disposed for being applied against the inside of the press belt as the press belt moves past the guide ledge. The beam supports the guide ledge against the press belt despite deflection of the supporting body with respect to the press belt under load applied to the supporting body at the press nip. For example, the guide ledge may be supported by a support extending from the beam, through the supporting body and to the ledge at the interior of the press belt, whereby deflection of the supporting body will not cause shifting of the guide ledge radially with respect to the press belt.

The guide ledge or ledges are supported on supporting surfaces of the beam. The beam is adapted to cause the guide ledges to shift radially with respect to the supporting body. In particular, the beam includes a supporting surface(s) which communicates with the guide ledge(s) and which surface(s) is inclined with respect to the axis of the supporting body, such that axial movement of the beam with respect to the supporting body would shift the guide ledge(s) radially. Communication between the supporting beam support surface and the guide ledge(s) is through respective stay bolt(s) that extend through the supporting body and that are normally biased against the supporting surface and which support the ledge(s) for movement radially.

For minimizing the effect of deflection of the supporting body with respect to the beam, the two axially spaced apart locations at which the beam is supported to the supporting body are located inwardly from the ends of the beam so that a range in the total of 20% to 30% of the length of the beam extends axially beyond the two axially spaced apart locations.

It has been found that guide elements arranged within the closed loop of the tubular press belt and supported on the supporting body must be kept as free of deflection as possible. Otherwise, there is the danger that for the points of an imaginary line extending transversely to the direction of rotation on the press belt, paths of different lengths of the belt for one rotation will result. Since it is not possible at reasonable expense to provide deflection-free guide rolls within the very limited inner space surrounded by the press belt, guide ledges which are supported at various points long their lengths are provided as guide elements. Unless costly measures are taken, there is still in operation a certain deflection of the supporting body under the action of the pressing device. Therefore, a simple flexurally rigid beam is provided in accordance with the invention for supporting the guide ledges. The beam is preferable within the supporting body. This beam rests in two resting places on the supporting body. It is unimportant that these resting places descend by a small amount upon deflection of the supporting body. The only requirement is that the substantially flexurally rigid beam not be in some way forced to also deform upon the deflection of the supporting body. Despite deflection of the supporting body, that beam should retain its substantially undeflected shape. A possible slight deflection of that beam under its own weight can be ignored. Each of the guide ledges can now be mounted on the flexurally rigid beam by means of a few supports which extend in an approximately radial direction through the supporting body.

A single guide ledge, which rests as described above on the rigid beam, may under certain circumstances be sufficient. However, several such guide ledges can also be provided. In addition to providing one or more guide ledges described above, it is possible to provide at least one guide ledge which is fastened to the supporting body or which is at least supported on it. In particular, those guide ledges which are arranged in or in the vicinity of the horizontal central plane of the supporting body and along which the press belt passes in substantially vertical direction can participate in the deflection of the supporting body without substantially disturbing the path of revolution of the press belt.

As a further alternative, at least one of the guide ledges which rests on the supporting body may be produced with a negative barreling, i.e. with a belt travel surface which is inwardly curved. This would cause the belt travel surface to be straight upon the customary amount of deflection of the supporting body.

The guide ledges are preferably developed in such a manner or are so adapted to the periphery of the corresponding press belt that they rest with only sight force against the inner side of the press belt. In other words, the guide ledges serve only to a very slight extent for tensioning the press belt in the radial direction. It may, however, be advisable for the guide ledges to be displaceable in their radial directions. In this way, the quietness in operation of the press belt can possibly be further increased during operation, if necessary. Alternatively, one can possibly reduce an excessively high pressure of a guide ledge. Above noted DE-OS No. 31

02 526 suggests arranging a liquid cushion between a tensioning ledge and the supporting body. By varying the amount of liquid in it, the tensioning ledge can be displaced radially.

Alternatively, the above-mentioned flexurally rigid beam may have, for radial displacement of one or more guide ledges, support surfaces which are inclined in wedge shape and that are active for causing radial displacement when that beam is displaced in the axial direction. In this way, radial deflection-free supporting of the guide ledges on the beam is retained. Furthermore, if necessary, several guide ledges, for instance those arranged on opposite places on the periphery of the supporting body, can be displaced in radial directions simultaneously. This facilitates the handling of the displacement device, for instance, also during the mounting of the press belt.

The supportng body customarily consists of a tubular main part. To each of the ends of the supporting body, there is fastened a supporting disk with a journal pin developed on it.

According to the invention, the flexurally rigid beam need not be made longer than, but instead may be somewhat shorter than the guide ledges. Therefore, the beam does not have to extend into the hollow journal pins of the supportng body. In other words, the beam extends exclusively within the tubular main part of the supporting body and is at a place where the radial space is not excessively constricted.

It has already been mentioned that the support places for the flexurally rigid beam will follow along upon the deflection of the supporting body without the beam being deformed. Upon the deflecton of the supporting body, the maximum distance between the line of bend of the supporting body and the deflection-free longitudinal axis of the beam and of the guide ledges supported on it is substantially less than would occur when the support points of the beam are arranged at the beam ends.

Other objects and features of various embodiments of the invention will be described below with reference to the accompanying drawings.

BRIEF DESCRIPTION OF THE DRAWINGS

FIG. 2 is a longitudinal section through one of the two ends of the belt press unit, along the line II—II of FIG. 1;

FIG. 2*a* is a longitudinal section through the other end of the press belt unit, along the line II*a*—II*a* of FIG. 1;

FIG. 5 diagrammatically shows a detail from FIGS. 2 and 2*a*.

DESCRIPTION OF A PREFERRED EMBODIMENT

Figure 1:
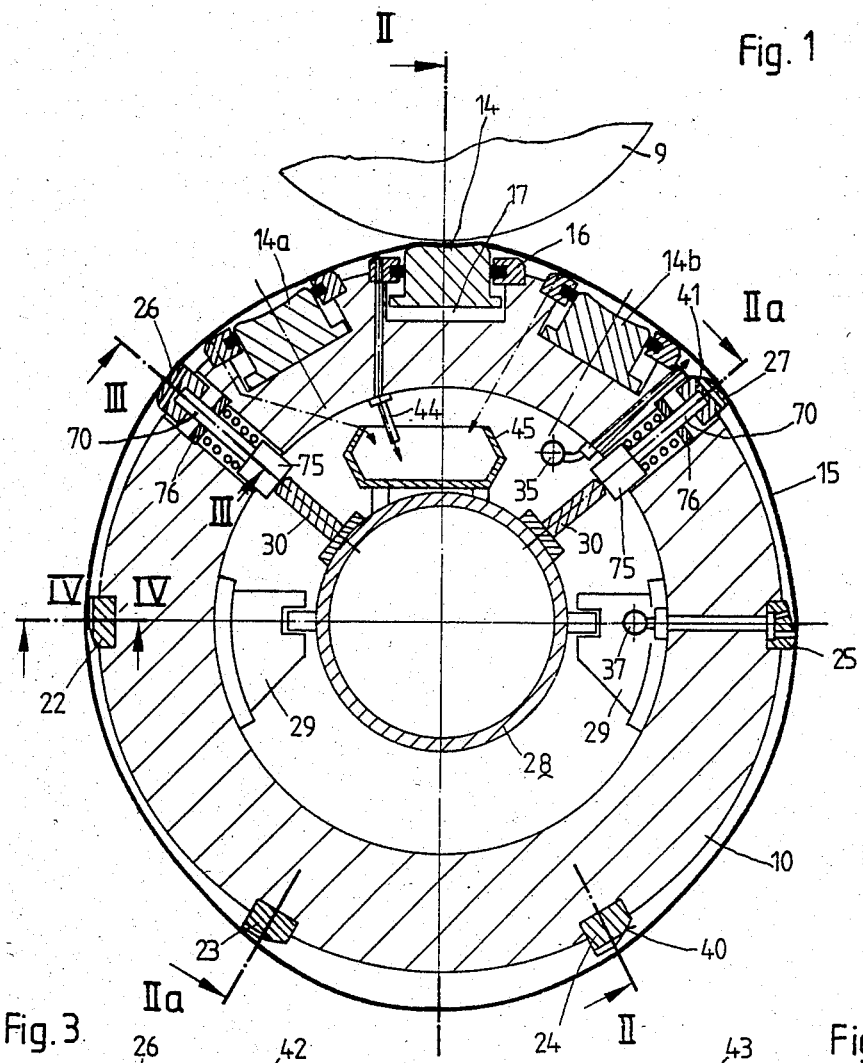
FIG. 1 is a cross-section through a belt press unit along the line I—I of FIG. 2.

The belt press unit shown includes an annular, roll-shaped supporting body 10 which has a narrowed diameter and thickness hollow journal pin 11 at each of its axial ends. The pins 11 are supported in machine frames 13 by means of spherical bushings 12.

There is a mating or back roll 9. Opposite the back roll 9 and within a recess in the external surface of the supporting body 10, there is a press shoe 14 of an axial length corresponding approximately to the width of the web of paper to be treated. That surface of the press shoe 14 which faces the back roll 9 is adapted in the customary manner to the shape of the back roll. A tubular elastic press belt 15 travels through the circumferentially "extended" press nip formed in this manner and wraps around the supporting body 10. The web of paper which has passed through the press nip and the felt belt which bears and also dewaters the web of paper have been omitted from the drawing. The supporting body 10 has a packing 16 which extends annularly around the press shoe 14 to separate its pressing surface from the recess radially inwardly of the press shoe. In this way, the press shoe 14 cna press the press belt 15 against the back roll 9 by the action upon the press shoe of pressure in the recess 17. In this connection, the supporting body 10 can deflect under the pressing force while the press shoe 14 and the press belt 15 apply themselves uniformly against the back roll 9.

Each of the two axial ends of the press belt 15 is clamped in a respective turnable disk 18. That disk is mounted by an antifriction bearing 19 on a bearing ring 20 which rests in an axially displaceable but non-rotatable manner on the journal pin 11. The press belt 15 is axially tensioned by outwardly biased compression springs 21. In view of the deflection of the supporting body 10, 11, the antifriction bearings 19 can be self-aligning bearings. The outer ends of the hollow journal pins 11 are closed by caps 11*a* so that the press belt 15 can be "inflated" by the introduction of compressed air. The means for feeding compressed air, as well as the packings required in connection with the antifriction bearings 19, have been omitted from the drawing.

FIG. 1 shows two additional press shoes 14*a* and 14*b* arranged on the two sides of the press shoe 14 in circumferential direction. These are spare press shoes which can be placed in use by swinging the supporting body 10 around its longitudinal axis.

In the embodiment shown, the back roll 9 is located above the belt pressing unit. However, any other arrangement is also conceivable.

The circumferential length of the press belt 15 is selected so that there is a predetermined circumferential length difference between the press belt and the supporting body 10, whereby the belt can be radially spaced from the body 10. In order that the press belt 15 can rotate quietly and without vibration at high speed, several guide ledges are arranged in the supporting body. Four rigid guide ledges 22 to 25 are fastened in the supporting body 10 along the horizontal plane and in the lower region. In the upper region, as close as possible to the press shoes 14*a* and 14*b*, there are two radially movable guide ledges 26 and 27. In order that the latter guide ledges remain unaffected by the deflection of the supporting body 10, 11, they are supported on a separate tubular beam 28 arranged within the internal space of the annular supporting body 10. The beam 28 rests at its two axial ends in supports 29 such that it does not participate in the deflection of the supporting body 10, 11 caused by the pressing force. On the beam 28, there are ribs 30 against which the guide ledges 26 and 27 rest via stay bolts 70 which extend through the supporting body 10. The guide ledges also do not participate in the deflection of the supporting body 10, 11. They are thus able to support the press belt with a slight tensioning or application force which is uniform over their axial length, regardless of how much the supporting body 10, 11 is deflected.

FIG. 2*a* shows that the ribs 30 have support surfaces 71 with respective wedge-like inclination, on which the support bolts 70 rest. The beam 28 can be displaced axially by means of a spindle 72, with handwheel 73, within the supporting body 10. In this way, radial mobility of the guide ledges 26 and 27 is assured. It is alternatively possible that the support surfaces 71, which correspond to one of the guide ledges, would not be inclined but instead extend parallel to each other so that the guide ledge, while being supported on the beam 28 would, however, not be radially movable.

As shown in FIGS. 2 and 2*a*, the supports 29 for carrying the beam 28 are arranged on the ends of the beam. Instead of this, these supports can also be arranged closer to the center, for instance, such that there is a distance of about 25% of the beam length L, as shown diagrammatically in FIG. 5, between the supports 29' and the ends of the beam 28. In this way, the line of bend b of the support tube 10 is deflected by smaller amounts from the beam longitudinal axis a (and thus from the guide ledges 26 and 27) than in the arrangement shown in FIGS. 2 and 2*a*. The beam length L is somewhat smaller than the length of the guide ledges 26, 27.

Figure 3:
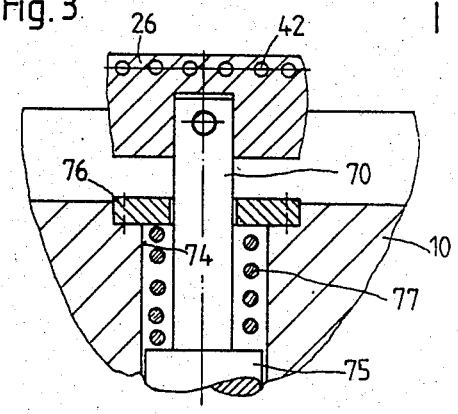
FIG. 3 is a partial section along the line III—III of FIG. 1.

FIGS. 1, 2*a* and 3 show that the guide ledges 26 and 27 are guided in radial bores 74 in the supporting body 10 by means of the stay bolts 70 projecting from those bores. For this purpose, each stay bolt 70 has a collar 75 which fits in the bore 74. On the outer end of the bore, a disk 76 is fastened on the supporting body 10. Between the disk and collar 75, a compression spring 77 is clamped. In this way, the guide ledges 26, 27 are continuously in contact via the bolts 70 with the ribs 30 of the beam 28. This also permits simple mounting of the guide ledgs 26, 27 on the supporting body 10 from the outside.

In FIG. 1, the press belt 15 is shown as it would appear at rest or moving with only a slight circumferential speed, and already under a certain internal air pressure. The belt lies against the ledges 26 and 27 and, in general, also still lightly contacts the lateral ledges 22 and 25. At high speed, in contrast, the belt travels substantially on a circular path while outside the press zone due to the effects of the centrifugal force. In that case, the deflection of the path of travel at the upper ledges 26 and 27 would be less than that shown in FIG. 1 as the stretched out belt presses upon those ledges. At the same time, the press belt can come lightly into contact with the lower ledges 23 and 24.

For cooling and lubricating the press belt 15, cooling oil is fed (in accordance with co-pending U.S. patent application Ser. No. 592,628, filed on Mar. 23, 1984, by Karl Steiner, Christian Schiel, Albrecht Meinecke, Josef Müllner and Hans Weiss, entitled "Apparatus and Method for Cooling a Belt Pressing Unit in a Paper Machine") via the line 35 and/or 37. The oil is discharged via channels 44, trough 45 and discharge pipe 46. Since the trough 45 rests on the axially movable beam, the discharge pipe 46 is divided in two and provided with a telescopic connection 46*a*.

Figure 4:
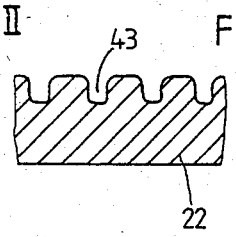
FIG. 4 is a partial section along the line IV—IV of FIG. 1.

The rotation of the liquid, together with the press belt 15, should be decelerated as little as possible by the application of the guide ledges against the press belt. Particularly with rigid ledges 22 to 25, the guide surface is inclined radially inwardly toward the axis of rotation in the direction opposite the direction of travel of the belt, for instance at 40 on the guide ledge 24. The radially displaceable guide ledges 26 and 27 are rounded along their entrance sides, for instance at 41 on the guide ledge 26. In addition, passage openings can be provided for the oil in the guide ledges. These openings extend in the direction of travel of the press belt. Bores 42 shown in FIG. 3 or openings 43 in the guide surface shown in FIG. 4 perform this function.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A belt press unit for a paper machine, comprising:

a supporting body for a press belt; the supporting body having an outwardly urgable press shoe supported thereon, and the press shoe being for pressing a press belt that is located around the supporting body against an opposing surface; an opposing surface positioned to sustain the pressure of the press shoe; a press zone defined at the press shoe; the supporting body being slightly deflectable under the force of the press shoe against the opposing surface;

an elastic press belt extending around the supporting body, the elastic press belt being closed upon itself for forming a tubular shape and thereby defining a closed inner space within the press belt; the press belt extending over the press shoe for being pressed against the opposing surface by the press shoe; the press belt being sized and shaped with respect to the supporting body for defining a distance between the press belt and the supporting body outside the press zone along the path of the press belt around the supporting body; the press belt being movable along a path of travel;

at least one guide ledge supported on the supporting body circumferentially outside the press zone; the guide ledge extending longitudinally for substantially the length of the supporting body and being shaped and positioned with respect to the supporting body for resting against the inner surface of the press belt as the press belt travels around the supporting body and the press belt riding on the guide ledge;

a substantialy flexurally rigid beam extending along the supporting body and being surrounded by the press belt which extends around the beam, the beam being spaced from the supporting body and extending in a direction across the path of travel of the press belt; the beam being supported on the supporting body at two axially spaced apart locations along the beam;

said at least one guide ledge being supported on the beam and extending across the path of travel of the press belt for also being applied against the inside of the press belt as the press belt moves past the guide ledge.

2. The unit of claim 1, wherein the two axially spaced apart locations of the support of the beam on the supporting body are located so that in the range of 20% to 30% of the total length of the beam extends axially beyond the two axially spaced apart locations.

3. A belt press unit for a paper machine, comprising:

a supporting body for a press belt; the supporting body having an outwardly urgable press shoe supported thereon, and the press shoe being for pressing a press belt that is located around the supporting body against an opposing surface; an opposing surface positioned to sustain the pressure of the press shoe, a press zone defined at the press shoe; the supporting body being slightly deflectable under the force of the press shoe against the opposing surface;

an elastic press belt extending around the supporting body, the elastic press belt being closed upon itself for forming a tubular shape and thereby defining a closed inner space within the press belt; the press belt extending over the press shoe for being pressed against the opposing surface by the press shoe; the press belt being sized and shaped with respect to the supporting body for defining a distance between the press belt and the supporting body outside the press zone along the path of the press belt around the supporting body; the press belt being movable along a path of travel;

at least one guide ledge supported on the supporting body circumferentially outside the press zone; the guide ledge extending longitudinally for substantially the length of the supporting body and being shaped and positioned with respect to the supporting body for resting against the inner surface of the press belt as the press belt travels around the supporting bodyand the press belt riding on the guide ledge;

a substantially flexurally rigid beam extending along the supporting body and being surrounded by the press belt which extends around the beam, the beam being spaced from the supporting body and extending in a direction across the path of travel of the press belt; the beam being supported on the supporting body at two axially spaced apart locations along the beam;

said at least one guide ledge being supported on the beam and extending across the path of travel of the press belt for also being applied against the inside of the press belt as the press belt moves past the guide ledge;

the beam being axially displaceable with respect to the supporting body; the beam including a support surface thereon which is engageable with the ledge, and the support surface being inclined with respect to the axial displacement of the beam for axial displacement of the beam to cause radial displacement of the ledge.

4. A belt press unit for a paper machine, comprising:

a supporting body for a press belt; the supporting body having an outwardly urgable press shoe supported thereon, and the press shoe being for pressing a press belt that is located around the supporting body against an opposing surface; an opposing surface positioned to sustain the pressure of the press shoe; a press zone defined at the press shoe; the supporting body being slightly deflectable under the force of the press shoe against the opposing surface;

an elastic press belt extending around the supporting body, the elastic press belt being closed upon itself for forming a tubular shape and thereby defining a closed inner space within the press belt; the press belt extending over the press shoe for being pressed against the opposing surface by the press shoe; the press belt being sized and shaped with respect to the supporting body for defining a distance between the press belt and the supporting body outside the press zone along the path of the press belt around the supporting body; the press belt being movable along a path of travel;

at least one guide ledge supported on the supporting body circumferentially outside the press zone; the guide ledge extending longitudinally for substantially the length of the supporting body and being shaped and positioned with respect to the supporting body for resting against the inner surface of the press belt as the press belt travels around the supporting body and the press belt riding on the guide ledge;

a substantially flexurally rigid beam extending along the supporting body and being surrounded by the press belt which extends around the beam, the beam being spaced from the supporting body and extending in a direction across the path of travel of the press belt; the beam being supported on the supporting body at two axially spaced apart locations along the beam;

said at least one guide ledge being supported on the beam and extending across the path of travel of the press belt and for also being applied against the inside of the press belt as the press belt moves past the guide ledge;

the guide ledge including a plurality of axially spaced stay bolts; each stay bolt being connected with the ledge at the radially outward end of the bolt and each stay bolt including a radially inward end; the beam including a support surface against which the radially inward end of the stay bolt rests;

the beam support surface being movable with respect to the stay bolt for causing the stay bolt to move radially for moving the respective ledge radially; and the beam being axially displaceable with respect to the support body; and the supporting surface being inclined with respect to the axial displacement of the beam for axial displacement of the beam to cause radial displacement of the ledge.

5. A belt press unit for a paper machine, comprising:

a supporting body for a press belt; the supporting body having an outwardly urgable press shoe supported thereon, and the press shoe being for pressing a press belt that is located around the supporting body against an opposing surface; an opposing surface positioned to sustain the pressure of the press shoe; a press zone defined at the press shoe; the supporting body being slightly deflectable under the force of the press shoe against the opposing surface;

an elastic press belt extending around the supporting body, the elastic press belt being closed upon itself for forming a tubular shape and thereby defining a closed inner space within the press belt; the press belt extending over the press shoe for being pressed against the opposing surface by the press shoe; the press belt being sized and shaped with respect to the supporting body for defining a distance between the press belt and the supporting body outside the press zone along the path of the press belt around the supporting body; the press belt being movable along a path of travel;

at least one guide ledge supported on the supporting body circumferentially outside the press zone; the guide ledge extending longitudinally for substantially the length of the supporting body and being shaped and positioned with respect to the supporting body for resting against the inner surface of the press belt as the press belt travels around the supporting body and the press belt riding on the guide ledge;

a substantially flexurally rigid beam extending along the supporting body and being surrounded by the press belt which extends around the beam, the beam being spaced from the supporting body and extending in a direction across the path of travel of the press belt; the beam being supported along the supporting body at two axially spaced apart locations on the beam;

said at least one guide ledge being supported on the beam and extending across the path of travel of the press belt and for also being applied against the inside of the press belt as the press belt moves past the guide ledge;

the guide ledge including a plurality of axially spaced stay bolts; each stay bolt having a radially outward end and extending through the support body; each stay bolt being connected with the ledge at the radially outward end of the bolt and each stay bolt including a radially inward end; the beam including a support surface against which the radially inward end of the stay bolt rests;

the beam support surface being movable with respect to the stay bolt for causing the stay bolt to move radially for moving the respective ledge radially;

said guide ledge further comprising a spring connected with the stay bolt for urging the stay bolt radially inwardly against the support surface; said spring being a compression spring; the stay bolt having a collar on it, and the spring pressing against the collar; the spring also pressing against the supporting body for urging the stay bolt radially inwardly toward the beam;

the guide ledge further comprising a respective recess in the supporting body for each of the stay bolts, and each recess being sized for receiving the collar on the respective bolt, whereby the bolt may be installed radially from the outside; and a disk at the recess and being supported on the supporting body for defining the part of the supporting body against which the respective spring presses.

6. A belt press unit for a paper machine, comprising:

a supporting body for a press belt, and a press belt extending around the supporting body; the supporting body having an outwardly urgable press shoe supported thereon, and the press shoe being for pressing the press belt that extends around the supporting body against an opposing surface; the opposing surface being positioned to sustain the pressure of the press shoe; a press zone defined at the press shoe; the supporting body being slightly deflectable under the force of the press shoe against the opposing surface;

the press belt being closed upon for forming itself a tubular shape and thereby defining a closed inner space within the press belt; the press belt being movable along a path of travel; the press belt travelling over the press shoe for being pressed against the opposing surface by the press shoe; the press belt being sized and shaped with respect to the supporting body for defining a distance between the press belt and the supporting body outside the press zone along the path of travel of the press belt around the supporting body;

a substantially flexurally rigid beam extending along the supporting body and being surrounded by the press belt which extends around the beam, the beam being spaced from the supporting body and extending in a direction across the path of travel of the press belt; the beam being supported on the supporting body at two axially spaced apart locations along the beam;

at least one guide ledge supported on and extending longitudinally along the beam for substantially the length thereof and extending across the path of travel of the press belt for being applied against the inside of the press belt as the press belt moves past the guide ledge and structured so that the press belt rides on the guide ledges.

7. The belt press unit of claim 6, further comprising means on the supporting body circumferentially outside the press zone and shaped and positioned for resting against the inner surface of the press belt as the press belt travels around the supporting body.

8. The belt press unit of claim 7, wherein the means on the supporting body further comprises second ledges on the supporting body, the second ledges extending longitudinally along the length of the supporting body.

9. The belt press unit of claim 6, wherein the press belt is elastic.

10. The unit of claim 6, wherein the belt has axial ends which are closed off for enabling the tubular belt to be inflatable.

11. The unit of claim 6, wherein the supporting body has a circular circumference.

12. The unit of claim 6, wherein the beam has a circular cross section and wherein there are a plurality of the guide ledges supported on the beam at circumferentially spaced locations around the beam.

13. The unit of claim 6, wherein the guide ledge has an axial length that is at least equal to the axial length of the beam.

14. The unit of claim 13, wherein the two axially spaced apart locations of the support of the beam on the supporting body are located so that in the range of 20% to 30% of the total length of the beam extends axially beyond the two axially spaced apart locations.

15. The unit of claim 6, wherein the two axially spaced apart locations of the support of the beam on the supporting body are located so that a portion of the length of the beam extends axially beyond both of the two axially spaced apart locations.

16. The unit of claim 6, whrein the guide ledge includes a plurality of axially spaced stay bolts; each stay bolt having a radially outward end and extending through the supporting body; each stay bolt being connected with the ledge at the radially outward end of the bolt and each stay bolt including a radially inward end; the beam including a support surface against which the radially inward end of the stay bolt rests;

the beam support surface being movable with respect to the stay bolt for causing the stay bolt to move radially for moving the respective ledge radially.

17. The unit of claim 16, further comprising a spring connected with the stay bolt for urging the stay bolt radially inwardly against the support surface.

18. The unit of claim 17, wherein the spring is a compression spring; the stay bolt having a collar on it, and the spring pressing against the collar; the spring also pressing against the supporting body for urging the stay bolt radially inwardly toward the beam.

19. The unit of claim 6, wherein the guide ledge is arched concavely at the side thereof facing toward and with respect to the press belt path of travel.

20. The unit of claim 6, wherein the supporting body is hollow, and the beam extends through the hollow of the supporting body; means extending radially through the supporting body connecting the beam in the hollow of the supporting body to the ledge radially outside the supporting body.

* * * * *